United States Patent [19]

Müller

[11] Patent Number: 4,577,851

[45] Date of Patent: Mar. 25, 1986

[54] DEVICE FOR SINGLING OUT STACKED SHEETS

[75] Inventor: Wilhelm Müller, Frankfurt, Fed. Rep. of Germany

[73] Assignee: Postalia GmbH, Berlin, Fed. Rep. of Germany

[21] Appl. No.: 723,977

[22] Filed: Apr. 16, 1985

Related U.S. Application Data

[63] Continuation-in-part of Ser. No. 367,895, Apr. 13, 1982, abandoned.

[30] Foreign Application Priority Data

Apr. 15, 1981 [DE] Fed. Rep. of Germany ..... 3115989

[51] Int. Cl.[4] ..... B65H 3/20

[52] U.S. Cl. ..... 271/33

[58] Field of Search ..... 271/33; 221/210, 217

[56] References Cited

U.S. PATENT DOCUMENTS 2,351,367 6/1944 Rider ..... 271/33

3,406,962 10/1968 Baron ..... 271/33

*Primary Examiner*—Richard A. Schacher

*Attorney, Agent, or Firm*—Herbert L. Lerner; Laurence A. Greenberg

[57] ABSTRACT

Device for individually separating sheets from a stack thereof by means of a band-shaped adhesive carrier extending from a supply roller over guide rollers to a wind-up roller, action of the adhesive carrier being adaptable to characteristics of the sheet surface by selection of various guide-roller profiles, including an adhesive head and a drum mounted on a disk so as to afford both angular displacement as well as rotation of the adhesive head, the disk forming an inner bearing ring of the drum for feeding the sheets, the adhesive head having a side mounting plate, one of the guide rollers projecting in use beyond the side mounting plate of the adhesive head and beyond the drum, at a location of adhesion between the adhesive carrier and a sheet to be individually separated from a stack thereof.

5 Claims, 1 Drawing Figure

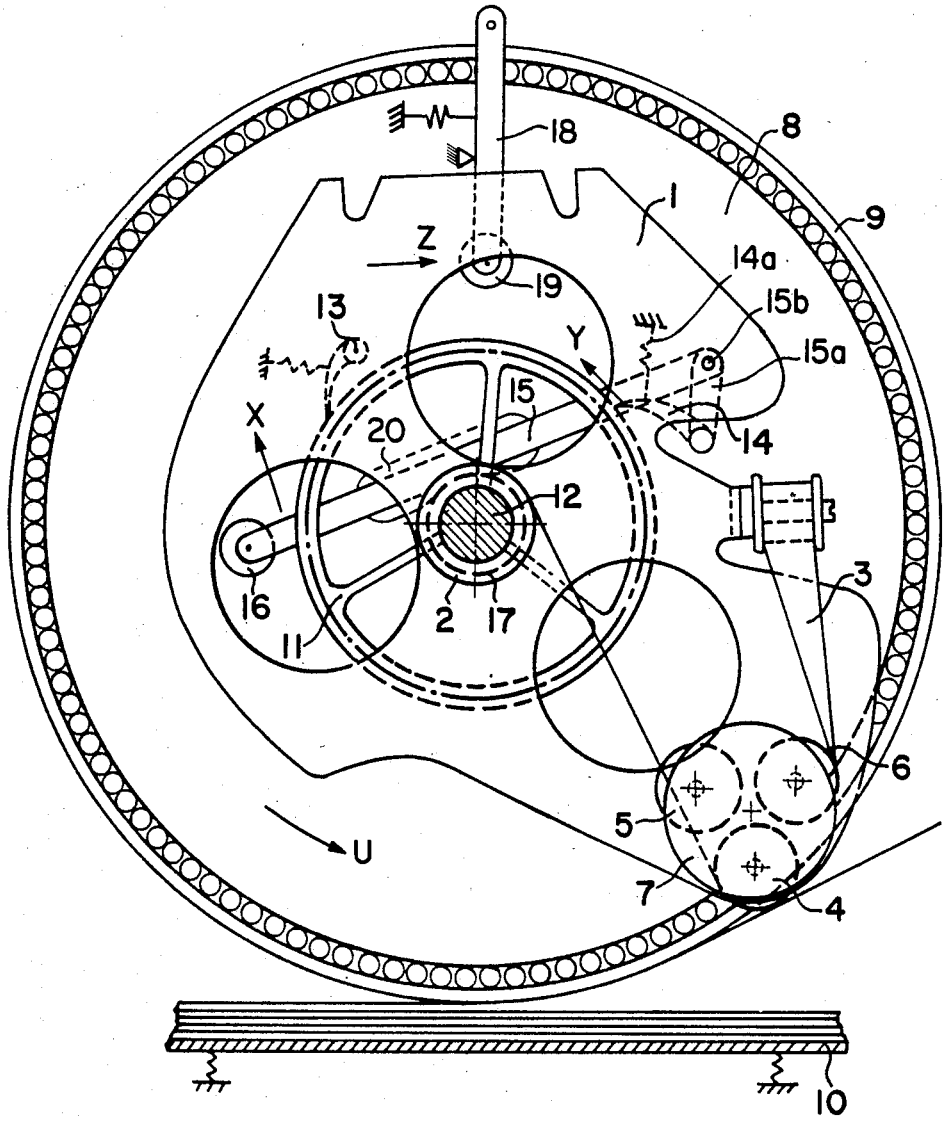
18
8
9
1
Z
19
14a
15b
13
Y
15a
15
X
20
14
12
3
16
2
17
11
6
5
U
7
4
10

DEVICE FOR SINGLING OUT STACKED SHEETS

This is a continuation-in-part of application Ser. No. 367,895 filed Apr. 13, 1982 and now abandoned.

The invention relates to a device for singling out or individually separating sheets from a stack thereof by means of a belt or band-shaped adhesive carrier, which is fed from a supply over guide rollers to a wind-up roller, the action of the adhesive carrier being adaptable to the characteristics of the sheet surface by the selection of various guide-roller profiles.

Devices for singling out or individually separating sheets for sorting or classifying the leaf-shaped material or for feeding it to further-processing machinery, such as printing, packaging, folding, stamping and other machines, are known. Thus, for example, German patent 1 082 278 shows a device using an adhesive tape or band. The feed of this heretofore known adhesive tape is controlled by means of an eccentric or cam, which actuates a selector fork which, in turn, permits a pawl in conjunction with a detent to act upon a ratchet wheel. The eccentric or cam is timed or adjusted by swinging motion of the adhesive-roller carrier. This heretofore known device requires a relatively great mechanical expense for the indexing or stepping of the adhesive carrier. Furthermore, the swinging motion necessitates a slow-down of the speed at which the sheetlike material is conveyed or transported.

Another device for singling out stacked sheets is shown in German Published Non-Prosecuted Application (DE-OS) No. 2 754 434. This known device also is intended for swinging. It has additional cam levers for releasing or locking the adhesive carrier and permits the use of guide rollers having varying profiles.

It is an object of the invention to provide a device for singling out or individually separating a sheet from a stack thereof which affords a higher transport speed for the sheets, a less expensive mechanical construction of the adhesive-carrier indexing system and a relatively simple provision for exchanging guide rollers.

With the foregoing and other objects in view, there is provided, in accordance with the invention, a device for individually separating sheets from a stack thereof by means of a band-shaped adhesive carrier extending from a supply roller over guide rollers to a wind-up roller, action of the adhesive carrier being adaptable to characteristics of the sheet surface by selection of various guide-rollers profiles, comprising an adhesive head and a drum mounted on a disk so as to afford both angular displacement as well as rotation of the adhesive head, the disk forming an inner bearing ring of the drum for feeding the sheets, the adhesive head having a side mounting plate, one of the guide rollers projecting in use beyond the side mounting plate of the adhesive head and beyond the drum at a location of adhesion between the adhesive carrier and a sheet to be individually separated from a stack thereof.

In accordance with another feature of the invention, there are provided two plates between which the one guide roller and others of the guide rollers having varying profiles are mounted and are pivotable with respect to the side sheet bar of the adhesive head.

In accordance with a further feature of the invention, there is provided a lever operatively connected to the adhesive head and actuatable by movement of the adhesive head for moving an indexing gear, by means of a spring-loaded pawl, for rotating the wind-up roller.

In accordance with an added feature of the invention, there is provided a wheel of elastic material forming a damper for a stop of the lever.

In accordance with a concomitant feature of the invention, the lever is surrounded with elastic material.

Other features which are considered as characteristic for the invention are set forth in the appended claims.

Although the invention is illustrated and described herein as embodied in a device for singling out stacked sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is a diagrammatic side elevational view of the device for singling out or individually separating stacked sheets.

Referring now to the FIGURE of the drawing, there is shown an adhesive head carrying, at the outside thereof, a non-illustrated supply roller and a wind-up roller for an adhesive carrier 3. The adhesive carrier 3 is fed in a conventional manner from the non-illustrated supply roller on the one side to the wind-up roller 2 on the other side of the adhesive head by means of deflecting or reversing rollers. At one location, a guide roller 4 projects, to a slight extent, beyond a side mounting plate 1 of the adhesive head. This provides the adhesion points for the sheetlike material. The guide roller 4 is mounted, together with further guide rollers 5 and 6, between two plates 7, only one of which is shown in the FIGURE. The shafts of the guide rollers 4, 5 and 6, on the side facing the mounting plate 1 of the adhesive head, project beyond the respective plates 7 and engage in perforations formed in the mounting plate 1. The plates 7 are coupled with the mounting plate 1 by a releasable connection, preferably of the threaded or screw type. In this manner, the engaging guide roller may be exchanged by unscrewing the connection thereof and swiveling the plates 7 about a given angle. By using a variety of profiles for the guide rollers 4, 5 and 6, the most desirable guide roller, respectively, is selectible for the particular leaf-shaped material being used.

Instead of a screwed or threaded connection of the plates 7 to the mounting plate 1 of the adhesive head, a detent or stop member for the plates 7 e.g. by ball, roller or spring arresting means, is also provided. The setting or adjustment of another guide roller is possible without using any tool.

The adhesive head is rigidly mounted on a disk 8. This provides two options for moving the adhesive head. Angular displacement or rotary movement of the adhesive head is a function of the speed and subsequent processing, respectively, of the sheetlike material.

The sheetlike or leaf-shaped material is fed by means of a spring-mounted table board 10 toward or against a drum 9 mounted on ball bearings. The adhesive carrier on the fixed guide roller, i.e. the guide roller 4 in the illustrated embodiment, which projects beyond both the mounting plate 1 and the drum 9, lifts only the top leaf or top sheet, respectively, of the leaf-shaped material off the stack thereof on the table board 10.

To advance or index the adhesive carrier 3, an indexing gear 11 is associated with the wind-up roller 2 on the shaft 12. A detent 13 and a pawl 14 engage the toothed rim of the indexing gear 11. Upon an angular displacement or revolution of the adhesive head, the end of a lever 15 runs against a wheel or stop 18 and actuates the pawl 14. The wind-up roller 2 accordingly turns through a small angle and the adhesive carrier 3 is wound up a length or is withdrawn, respectively, from the non-illustrated supply roller. The lever 15 has a roller 16 attached to the stop end thereof, which facilitates improved sliding at the stop 18. A further wheel 17 formed of elastic material is mounted on the shaft 12 and serves for damping the lever stop 18 after each further turn of the wind-up roller 2, the lever 15 being additionally surrounded by elastic material.

The wheel or stop 18 is provided for advancing or indexing the adhesive carrier 3 and is swung-in rhythmically when the adhesive head is rotating. The stop 18 is maintained in stationary position when the adhesive head is merely angularly displaced, which is the condition shown in the FIGURE.

When the adhesive head either rotates or is angularly displaced in direction of the arrow U, the roller 16 of the lever 15 comes into contact with the lever or stop 18 or the wheel 19 thereof. The lever 15 is rigidly coupled via the angular extension 15*a* with the pawl 14. Due to further movement of the adhesive head with the simultaneous engagement of the roller 16 with the wheel 19, the lever 15 is moved about the pivot access 15*b* in direction of the arrow X. The pawl 14 is thereby moved in direction of the arrow Y and turns the indexing gear 11 through a small angle also further in direction of the arrow Y. The wind-up roller 2 is thereby also moved and a length of the adhesive carrier 3 is withdrawn from the non-illustrated supply roller, i.e. a new adhesive location is made available at the guide roller 4. Due to the further turning of the adhesive head, the roller 16 and the wheel 19 slide on one another, because the position of the lever 15 with respect to the stop 18 is varied due to the increasing turning angle. After the roller 16 and the wheel 19 have separated from one another, the lever 15 falls back to the position thereof illustrated in the FIGURE due to the force of the spring 14*a*. To prevent the adhesive head from directly striking the shaft 12, the wheel 17 is formed of elastic material. The lever 15, thus, strikes or falls against this wheel 17. In addition, the lever 15 is surrounded with elastic material such as a rubber covering 20, to effect damping.

The detent 13 prevents reverse rotation or turning of the indexing gear 11, so that the adhesive carrier 3 is always guided tautly stressed over the guide rollers.

As aforementioned, the stop 18 is brought rhythmically into the integrated position shown in the FIGURE when the adhesive head is rotating. When the adhesive head is being angularly displaced i.e. a displacement in direction of the arrow U and a subsequent reverse displacement, the stop 18 must be spring mounted so that when the roller 16 travelling in the direction of the arrow C engages the step 18, it shifts the latter in this direction C, and the stop 18 then returns to its original position due to the spring force and, upon the return movement of the adhesive head, the stop 18 is again available as a stop.

I claim:

1. Device for individually separating sheets from a stack thereof by means of a band-shaped adhesive carrier extending from a supply roller over guide rollers to a wind-up roller, action of the adhesive carrier being adaptable to characteristics of the sheet surface by selection of various guide-roller profiles, comprising an adhesive head and a drum mounted on a disk so as to afford both angular displacement as well as rotation of said adhesive head, said disk forming an inner bearing ring of said drum for feeding the sheets, said adhesive head having a side mounting plate, one of the guide rollers projecting in use beyond said side mounting plate of said adhesive head and beyond said drum at a location of adhesion between said adhesive carrier and a sheet to be individually separated from a stack thereof.

2. Device according to claim 1 including two plates between which said one guide roller and others of the guide rollers having varying profiles are mounted and are pivotable with respect to said side mounting plate of said adhesive head.

3. Device according to claim 1 including a lever operatively connected to said adhesive head and actuatable by movement of said adhesive head for moving an indexing gear, by means of a spring-loaded pawl, for rotating the wind-up roller.

4. Device according to claim 3 including a wheel of elastic material forming a damper for a stop of said lever.

5. Device according to claim 3 wherein said lever is surrounded with elastic material.

* * * * *